US007845200B2

(12) United States Patent
Cimetta et al.

(10) Patent No.: US 7,845,200 B2
(45) Date of Patent: Dec. 7, 2010

(54) DRAIN PUMP

(75) Inventors: Silvano Cimetta, Treviso (IT); Flavio Noviello, Aviano (IT); Ugo Favret, Casarsa (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 292 days.

(21) Appl. No.: 12/089,457

(22) PCT Filed: Oct. 11, 2006

(86) PCT No.: PCT/EP2006/009809

§ 371 (c)(1),
(2), (4) Date: Apr. 7, 2008

(87) PCT Pub. No.: WO2007/042269

PCT Pub. Date: Apr. 19, 2007

(65) Prior Publication Data

US 2008/0250820 A1 Oct. 16, 2008

(30) Foreign Application Priority Data

Oct. 13, 2005 (EP) ..... 05109510

(51) Int. Cl.
*D06F 39/08* (2006.01)

(52) U.S. Cl. ..... 68/208; 134/186; 68/184

(58) Field of Classification Search ..... 68/208; 134/186; 415/143
See application file for complete search history.

(56) References Cited

U.S. PATENT DOCUMENTS 1,349,370 A * 8/1920 Dawson ..... 137/565.01
1,690,974 A * 11/1928 Hazard ..... 134/176
1,867,290 A * 7/1932 Vitu ..... 415/106
1,898,038 A * 2/1933 Dunham ..... 68/23.6
1,967,316 A * 7/1934 Meeker ..... 415/106
3,033,015 A * 5/1962 Stutrud ..... 68/23.6
4,008,985 A 2/1977 Schemmann et al.
4,435,193 A * 3/1984 Gullichsen et al. ..... 95/19
4,921,400 A * 5/1990 Niskanen ..... 415/169.1
5,116,198 A * 5/1992 Vesala et al. ..... 415/169.1

(Continued)

FOREIGN PATENT DOCUMENTS

DE 9103297 6/1991

(Continued)

OTHER PUBLICATIONS

European Patent Office 0 760 428 Mar. 1997.*

*Primary Examiner*—Frankie L Stinson
(74) *Attorney, Agent, or Firm*—Pearne & Gordon LLP

(57) ABSTRACT

Drain pump for clothes washing machines, comprising: an impeller having vanes (7) that are arranged on respective planes passing through the axis of said rotating shaft, said drain manifold being provided with a planar inner wall (9), in which there is provided a hollow space or separating gap (20) between said vanes of the pump impeller and said planar inner wall of said drain manifold, in which there are arranged a plurality of planar members (22) provided integral with said impeller and arranged in respective planes extending parallel to the axis of said rotating shaft (6). Said planar members have a height that is smaller than the height of said vanes, but greater than the largest radius of the central hub of said rotating shaft.

4 Claims, 3 Drawing Sheets

U.S. PATENT DOCUMENTS

| | | | | |
|---|---|---|---|---|
| 5,324,166 | A * | 6/1994 | Elonen et al. | 415/169.1 |
| 5,366,347 | A * | 11/1994 | Hoglund | 417/53 |
| 5,779,445 | A * | 7/1998 | Yokota et al. | 415/230 |
| 6,264,441 | B1 | 7/2001 | Marioni | |
| 6,824,350 | B2 * | 11/2004 | Pares Criville | 415/98 |
| 2007/0196211 | A1 * | 8/2007 | Marioni | 416/175 |

FOREIGN PATENT DOCUMENTS

| | | | |
|---|---|---|---|
| DE | 10219616 | | 11/2003 |
| EP | 0760428 | | 3/1997 |
| EP | 1760320 | A1 | 3/2007 |
| JP | 10-196580 | * | 7/1998 |
| JP | 2003230527 | | 8/2003 |
| SU | 941686 | * | 7/1982 |
| SU | 1190086 | * | 11/1985 |

* cited by examiner

DRAIN PUMP

The present invention refers to an improved kind of water circulating pump, as used in particular as a drain pump in a clothes washing machine, preferably of the type for use in households, which is capable of doing away with the risk of lint causing it to run into a stalled condition.

The general requirement for household appliances—and particularly clothes washing machines, which, among these appliances, are certainly most affected by this kind of considerations, i.e. most susceptible in this particular connection, owing to the peculiar manner in which they are used and operated—to be simplified as far as possible in the use and maintenance thereof.

A chore that users of such washing machines have quite frequently, i.e. periodically to grapple with is cleaning the so-called lint filter provided upstream of the drain pump.

The need for such filter to be used is generally known in the art, so that it shall not be dealt with any further here. On the other hand, the type of filter to be used can vary most widely depending on the actual needs that have to be complied with. Again, most varied results—from a practical point of view—are to be expected to derive from the use of different kinds of filters, i.e. different filter design options.

If—as this is increasingly the case nowadays—a design target is to as much as possible reduce, i.e. minimize the frequency of maintenance operations to clean and service the filter, the latter tends to be provided in the form of an almost "non-filter", i.e. more in the form of a sieve than an actual filter, in the sense that it is designed so as to be able to only intercept and retain the coarser and more sizeable matters that may be unintentionally end up in the washing tub of the machine along with the clothes to be washed and eventually in the flow of washing liquor being let out. These coarser or more sizeable matters may for instance be comprised of brooches, hairpins and the like, toothpicks, coins, small handkerchiefs, and the like. These matters, owing to their not really negligible consistency and size, may prove quite dangerous if allowed to reach the drain pump of the machine, since they can quite easily cause it to run into a stalled condition and, possibly, even damage it, thereby giving rise to a number of negative after-effects—even of an economic nature—as this can be most easily figured out.

If use is made on the contrary of very fine-meshed strainers, so as to cause also most of the lint carried away by the flow of washing liquor being let out to be intercepted and retained, a rapid clogging of the filter will be the obvious result, accompanied by a considerable increase in the frequency of operations needed to be normally performed in order to unclog and clean the filter.

On the other hand, the large amount of lint of various kind that separates from the washload, i.e. from the clothes during the washing process, and passes then through filters of the afore-cited "non-filter", i.e. sieve kind provided to only retain the coarser of more sizeable matters in the flow of the washing liquor being let out, is not really dangerous for the drain pump, since it is generally capable of being let out with the washing liquor without giving rise to clogging or similar problems.

This is actually the reason why filters used in currently produced washing machines are generally provided with quite large meshes, holes or other kinds of passages that are adapted to retain only the largest matters and bodies that may accidentally end up in the washing tub of the machine with the clothes to be washed, while enabling lint to pass therethrough.

However, although this lint is unable to cause the pump impeller to get locked, since they do not get entangled on the impeller, it has been nevertheless found that it may well roll up round the shaft that rotatably drives the same impeller, in the section thereof lying between the impeller vanes and the point at which it penetrates the wall of the drain manifold, which—owing to its having a much smaller diameter than the impeller—is unable to bring about any whirling water stream that would move away such lint.

The ultimate result is that the impeller is still likely to be braked, i.e. slowed down, or even locked by lint rolling up and getting entangled round the driving shaft thereof.

This occurrence is much more manifest if—as this is quite often the case—part of said driving shaft comes to lie freely extended and accessible between the vanes of the impeller and the inner wall of the drain manifold, in which said impeller is housed and from which said driving shaft comes out to reach the impeller.

It would therefore be desirable, and it is actually a main object of the present invention, to provide a drain pump for a clothes washing machine, which is capable of ensuring an adequate extent of inherent protection against lint, or other minute matters that may equally be carried away in the flow of washing liquor being let out, accidentally rolling up/getting entangled around the portion of the impeller driving shaft that extends from the vanes of said impeller to the wall from out it comes out.

According to the present invention, these aims, along with further ones that will become apparent further on in the following description, are reached in a drain pump for a clothes washing machine incorporating the features and characteristics as recited in the appended claims. Anyway, features and advantages of the present invention will be more readily and clearly understood from the description that is given below by way of non-limiting example with reference to the accompanying drawings, in which:

Figure 2:
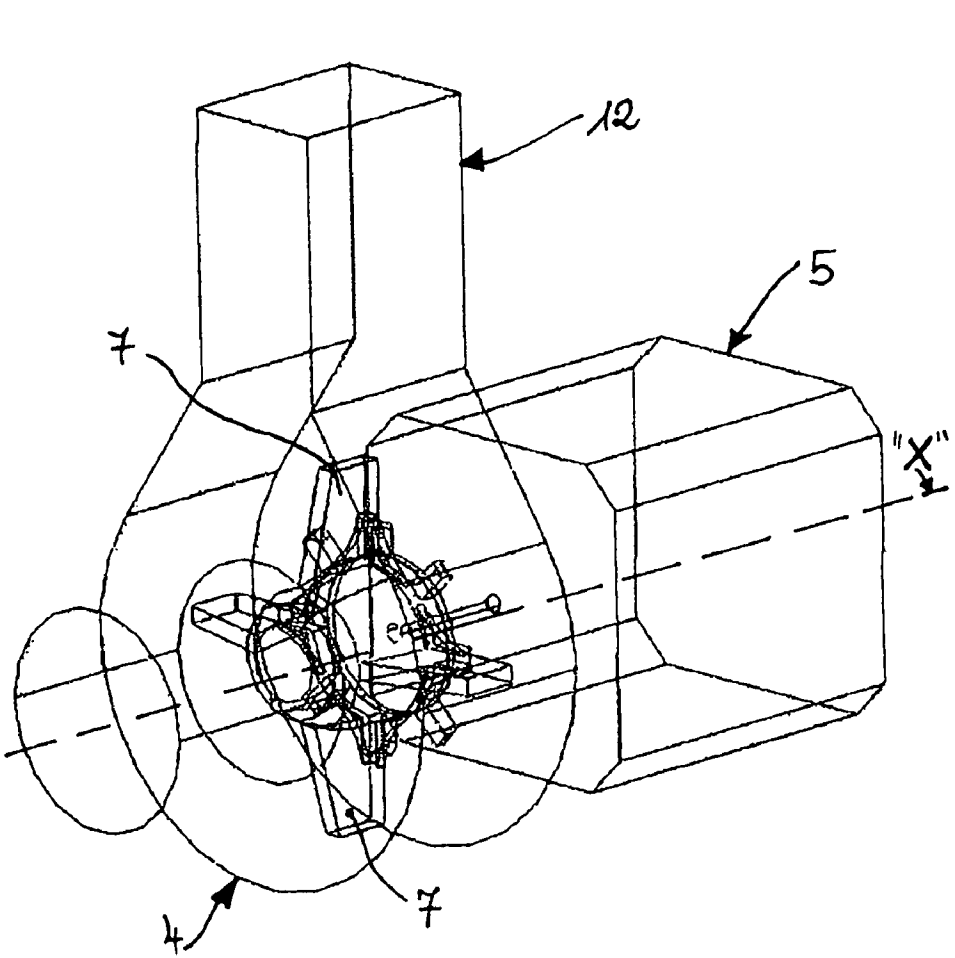
FIG. 2 is a schematical see-through view of a drain pump according to the present invention.
Figure 1:
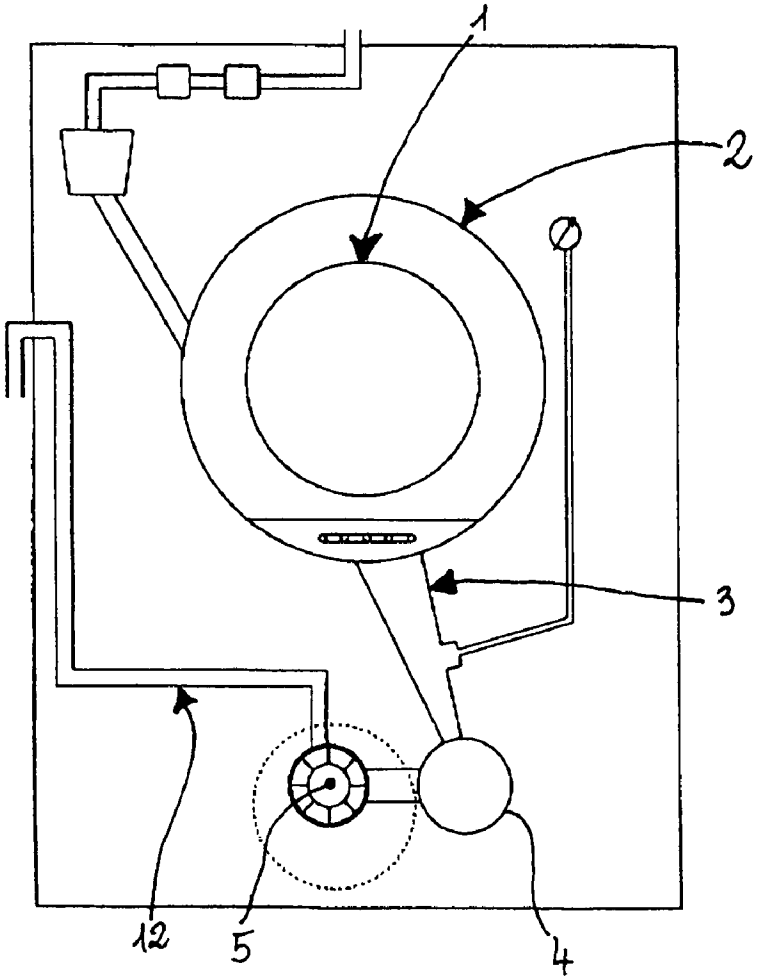
FIG. 1 is a schematical view illustrating the operating principles of a washing machine according to an embodiment of the present invention.

With reference to FIGS. 1 and 2, in a clothes washing machine that uses a drain pump according to the present invention there is provided a perforated rotating drum 1, a washing tub 2 accommodating said drum rotatably, and under this washing tub—as connected therewith via an appropriate conduit 3 opening at the bottom thereof—there is provided a related drain manifold 4 to collect the liquor being let off the tub.

In a manner that is generally known as such in the art, this drain manifold is associated to, and sometimes even includes, a drain pump 5, the driving or revolving shaft 6 of which extends into the interior of the pumping chamber of said drain manifold and terminates in an impeller, which is in turn provided with a plurality of vanes 7 arranged on respective planes that are regularly angled relative to each other, but passing in all cases through the axis X of said shaft 6.

Figure 4:
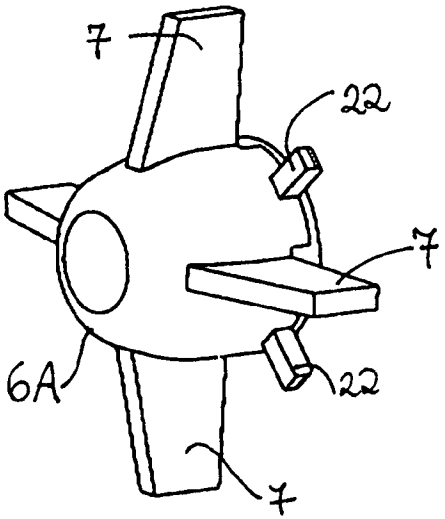
FIGS. 4 and 5 are a perspective view and a front elevational view, respectively, of the impeller of the pump shown in FIG. 3.
Figure 5:
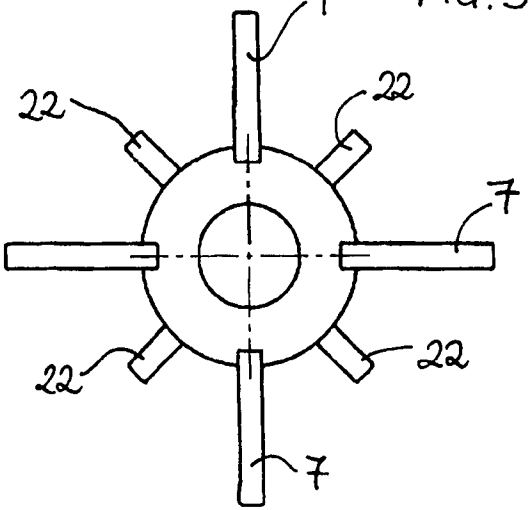
Figure 3:
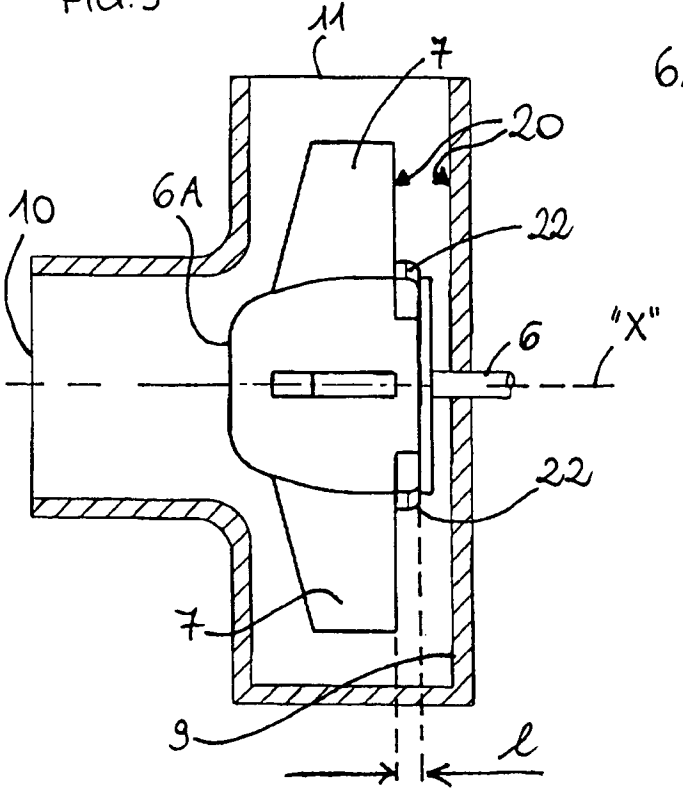
FIG. 3 is a an axially cross-sectional view of an embodiment of the drain pump according to the present invention.

With reference to FIGS. 3, 4 and 5, the wall 9, from which said shaft extends to enter said pumping chamber, is a planar wall. Moreover, said pumping chamber has two access apertures, or mouths, of which a first inflow aperture 10 is provided to connect said conduit 3 with said pumping chamber, whereas a second aperture 11 acts as an outflow aperture connecting the same pumping chamber with an outlet or drain pipe 12.

The first aperture 10 is so situated and oriented in the wall of said pumping chamber as to come to lie in front of the vanes of said impeller, where it substantially corresponds to, i.e. agrees with a plane lying orthogonally to the axis X of the shaft 6 used to rotatably drive the vanes 7.

The second aperture 11 is on the contrary situated laterally relative to said shaft, and is positioned in the substantially cylindrical wall of the pumping chamber, so that, when the impeller rotates, the vanes thereof successively expose all of their faces to said second aperture 11.

In a conventional manner, said vanes 7 are separated from the drive motor of the pump 5 by said planar wall 9, from which said shaft 6 comes out, and a hollow space or gap 20, which, if no adequate measure is taken, allows in fact for said lint to reach and settle on said shaft, as favoured by said first inflow mouth or aperture 10 being practically located in front of said shaft.

In view of avoiding such circumstance, according to the present invention provision is made of a plurality of members 22 that come to be arranged inside said hollow space, integral with or, anyway, firmly joined to the portion of said shaft 6 that extends therethrough.

Therefore, as it rotates to drive the impeller, the shaft 6 clearly causes even said members 22 to similarly rotate, so that they are able to bring about a moderate whirling effect—somewhat apart from the shaft itself—that is effective in preventing lint and other foreign matters from reaching the same shaft and, ultimately, braking or even locking it.

Figure 7:
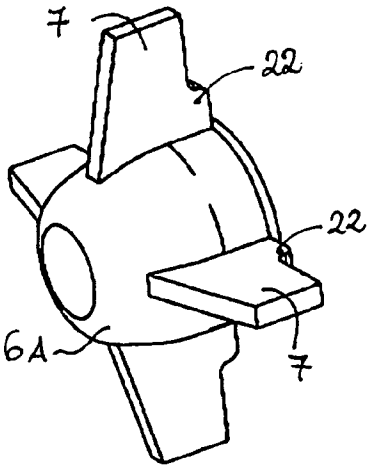
FIGS. 7 and 8 are a perspective view and a front elevational view, respectively, of the impeller of the pump shown in FIG. 3.
Figure 8:
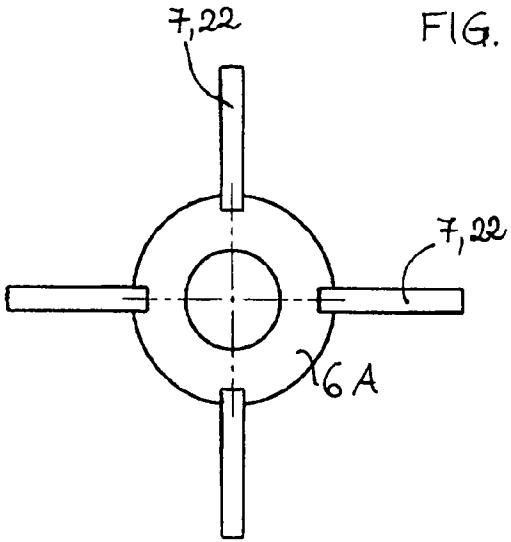
Figure 6:
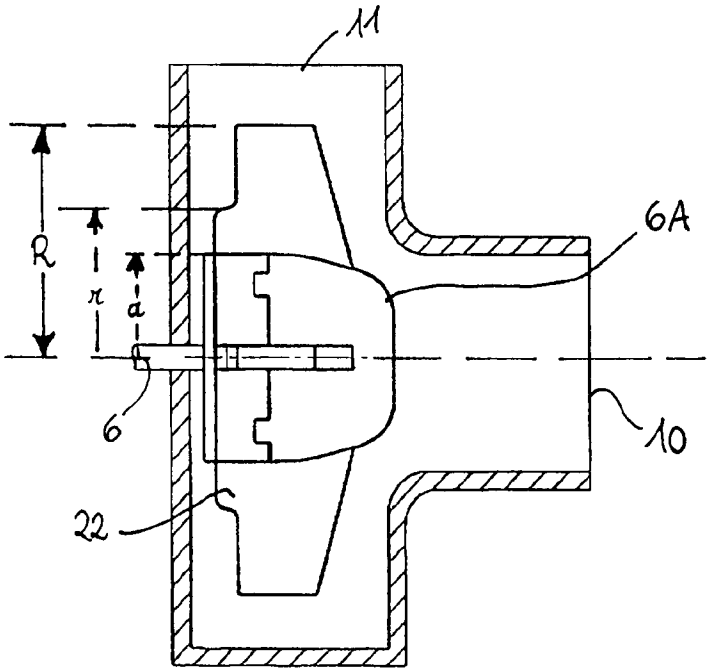
FIG. 6 is a an axially cross-sectional view of a second embodiment of a drain pump according to the present invention.

As broadly explained above, this solution has enough scope to further accommodate a number of improvements and modified embodiments. So, for instance,

- a first such improvement may rely on providing said members 22 in the form of planar members arranged on respective planes that are regularly angled relative to each other, but passing in all cases through the axis X of said shaft;
- a second improvement, which—as best illustrated in FIGS. 6, 7 and 8—is basically aimed at making it easier to manufacture said planar members 22, provides for the latter to be made in a co-planar arrangement with the respective vanes 7, wherein they are preferably made integral with said vanes as a unitary-piece construction requiring just a single manufacturing step, preferably an injection-moulding operation;
- a third improvement lies in sizing said planar members in their length "l"—as measured parallel to said axis X—so that they are able to extend throughout the width—or the depth—of said hollow space so as to minimize the possibility for any lint or foreign body whatsoever to actually reach the shaft (see FIG. 3);
- finally, a last improvement lies in sizing said planar members 22 in their height "a" so that they are able to extend above, i.e. are greater than the radius "r" of the central hub 6A of the shaft 6, to thereby generate a marked whirling effect, while at the same time being significantly lower than the radial dimension R of said vanes 7, so as to avoid interfering with the effectiveness of the pumping action thereof.

In fact, since said outflow aperture or mouth 11 is only aligned with and projects towards said vanes 7, and not also towards said hollow space 20, and since said vanes 7—on construction-related considerations—must be separated from said planar wall 9 by said hollow space 20, the volume defined by said hollow space 20 might therefore prove unable to be effectively drained by the action of the whirling effect produced by the contiguous vanes 7.

The invention claimed is:

1. Clothes washing machines comprising:

a perforated rotating drum holding the clothes to be washed, a stationary washing tub containing said rotating drum, a drain manifold arranged underneath said washing tub for letting off the liquid flowing in from said tub and accommodating a drain pump, said pump being provided with a rotating shaft extending into said drain manifold, and with an impeller comprising a rounded central hub having a largest radius and vanes radially extending from the rounded central hub, said vanes having a radial height greater than the largest radius of the central hub and being arranged at an angle relative to each other on respective planes passing through an axis of said rotating shaft, said vanes having only an end thereof, at the side of the axis, connected to the outer surface rounded central hub of the impeller so that said vanes are circumferentially separated one from each other, said drain manifold being provided with a substantially planar inner wall, from which said rotating shaft extends to enter said drain manifold, an outlet pipe connected at an end portion thereof to said drain manifold and adapted to convey outside the liquid being pushed by the action of said pump, an outflow aperture adapted to connect the inner volume of said drain manifold with said outlet pipe, provided in a position that is substantially parallel to the axis of said rotating shaft and situated laterally relative to said shaft so that the liquid exiting the drain manifold is adapted to flow along a direction substantially orthogonal to said axis, a first inflow aperture arranged in front of said vanes in a position that is parallel to the plane extending orthogonally to said axis so that the liquid entering the drain manifold is adapted to flow along a direction substantially parallel to said axis, a sleeve connecting an aperture in the bottom of said washing tub with said drain manifold, a hollow space or separating gap is provided between said vanes of the pump impeller and said planar inner wall of said drain manifold, characterized in that in said hollow space or separating gap there are arranged a plurality of planar members provided integral with said impeller and co-planar with the respective vanes of said impeller so that the planar members and the vanes are provided integral in a unitary-piece construction, said planar members have a radial height that is smaller than the radial height of said vanes, but greater than the largest radius of the central hub of the impeller.

2. Clothes washing machine according to claim 1, characterized in that said planar members have a length corresponding to the depth of said hollow space, so as to be able to extend throughout and substantially cover the entire depth of said separating hollow space.

3. Clothes washing machines comprising:

a perforated rotating drum holding the clothes to be washed, a stationary washing tub containing said rotating drum, a drain manifold arranged underneath said washing tub for letting off the liquid flowing in from said tub and accommodating a drain pump, said pump being provided with a rotating shaft extending into said drain manifold, and with an impeller comprising a rounded central hub having a largest radius and vanes radially extending from the rounded central hub, said vanes having a radial height greater than the largest radius of the central hub and being arranged at an angle relative to each other on respective planes passing through an axis of said rotating shaft, said vanes having only an end thereof, at the side of the axis, connected to the outer surface rounded central hub of the impeller so that said vanes are circumferentially separated one from each other, said drain manifold being provided with a substantially planar inner wall, from which said rotating shaft extends to enter said drain manifold, an outlet pipe connected at an end portion thereof to said drain manifold and adapted to convey outside the liquid being pushed by the action of said pump, an outflow aperture adapted to connect the inner volume of said drain manifold with said outlet pipe, provided in a position that is substantially parallel to the axis of said rotating shaft and situated laterally relative to said shaft so that the liquid exiting the drain manifold is adapted to flow along a direction substantially orthogonal to said axis, a first inflow aperture arranged in front of said vanes in a position that is parallel to the plane extending orthogonally to said axis so that the liquid entering the drain manifold is adapted to flow along a direction substantially parallel to said axis, a sleeve connecting an aperture in the bottom of said washing tub with said drain manifold, a hollow space or separating gap is provided between said vanes of the pump impeller and said planar inner wall of said drain manifold, characterized in that in said hollow space or separating gap there are arranged a plurality of planar members provided integral with said impeller, said planar members being arranged on respective planes that are regularly angled relative to each other and passing through said axis, each planar members is arranged on a plane angularly equidistant from two consecutive planes of the vanes, each planar member having only an end thereof, at the side of the axis, connected to the outer surface of rounded central hub of the impeller so that said planar members are separated one from each other, each of said planar members have a radial height that is smaller than the radial height of said vanes, but greater than the largest radius of the central hub of the impeller.

4. Clothes washing machine according to claim 3, characterized in that said planar members have a length corresponding to the depth of said hollow space, so as to be able to extend throughout and substantially cover the entire depth of said separating hollow space.

* * * * *